United States Patent [19]

Schuegraf

[11] 4,272,744

[45] Jun. 9, 1981

[54] RECTANGULAR WAVEGUIDE ELBOW BENT ACROSS THE BROAD SIDE OF THE WAVEGUIDE WITH CORNER FLATTENING AND A TRANSVERSE BAR

[75] Inventor: Eberhard Schuegraf, Munich, Fed. Rep. of Germany

[73] Assignee: Siemens Aktiengesellschaft, Berlin & Munich, Fed. Rep. of Germany

[21] Appl. No.: 113,174

[22] Filed: Jan. 18, 1980

[30] Foreign Application Priority Data

Jan. 31, 1979 [DE] Fed. Rep. of Germany ..... 2903665

[51] Int. Cl.[3] ..... H01P 1/02

[52] U.S. Cl. ..... 333/249; 333/33

[58] Field of Search ..... 333/249, 248, 251, 239, 333/33, 27, 24 R

[56] References Cited

U.S. PATENT DOCUMENTS 2,737,634 3/1956 Lewin et al. ..... 333/249

FOREIGN PATENT DOCUMENTS 679902 9/1952 United Kingdom ..... 333/249

OTHER PUBLICATIONS

Meinke et al.-"Taschenbuch Der Hochfrequenztechnik" Springer-Verlag, Berlin, 1962, pp. 401-402.

*Primary Examiner*—Marvin L. Nussbaum

*Attorney, Agent, or Firm*—Hill, Van Santen, Steadman, Chiara & Simpson

[57] ABSTRACT

A rectangular waveguide elbow (E-elbow) bent across the broad side of the waveguide with an outer corner symmetrically flattened by conductive flattening or smoothing plane which provides for elimination of undesirable reflections by providing a cross cylindrical bar at the median between the inner corner and the center of the flattening or smoothing plane and wherein the cylindrical bar has an enlarged portion at its center which extends a portion length of the bar. A second embodiment provides a bar which does not have an enlarged portion but wherein the diameter of the bar ratio to the length of the shorter side of the waveguide is at least 0.258.

3 Claims, 5 Drawing Figures b
a
x 80
60
40
30
20
10
8
7
6
5
4
3
2
1,8
1,6
1,4
1,2
1
1,2
S
fk
3
f[GHz]
4
5
x/a = 0
x/a = 0,202
x/a = 0,332
x0/a = 0,395

RECTANGULAR WAVEGUIDE ELBOW BENT ACROSS THE BROAD SIDE OF THE WAVEGUIDE WITH CORNER FLATTENING AND A TRANSVERSE BAR

BACKGROUND OF THE INVENTION

1. Field of the Invention

This invention relates in general to rectangular waveguide with elbows (E-elbow) which are bent across the broad side of the waveguide with the outer corners symmetrically flattened by conductive flattening or smoothing planes.

2. Description of the Prior Art

Such elbows are described, for example, in "Taschenbuch der Hochfrequenztechnik", by H. Meinke and F. W. Fundlach, Springer Verlag, 2nd Edition, 1962, pages 401 and 402. Such elbows are utilized in various microwave circuits with rectangular waveguides. By using angled waveguides a more compact structure is achieved as compared to a comparable low-refraction circular arc elbow, particularly for use as waveguide shunts are filters of different types, such as for example fixed frequency shunts or filters, polarization shunts or filters or wave mode shunts or filters. Using waveguides with a rectangular cross-section having a side ratio of a:b equal to 2:1 are most often utilized. Such waveguides can be used in the relative frequency range with a maximum bandwidth of $f_o$ and $f_u$=2:1 for the TE10 wave. Also, as discussed in the above reference publication "Taschenbuch der Hochfrequenztechnik" the reflection of an E-elbow can be reduced if, as shown in FIG. 1*a*, the exterior corner of the elbow is symmetrically flattened or smoothed with a conducting plane. FIG. 1*b* illustrates the standing wave ratio s at frequencies f for E-elbows as shown in FIG. 1*a* with corner flattening planes of varying degrees. The optimum cathetus measurement $x_o$ is shown in the lowest curve wherein the ratio of $x_o/a=0.395$ wherein a is the width of the long side of the waveguide has been derived and described in the above referenced publication. With such ratio, the reflection of an E-elbow will remain under r=5% in the frequency range of a waveguide which will usually be 1.25 fcTE10 through 1.9 fcTE10. Only in partial frequency bands of this frequency range can smaller reflections be achieved and for this purpose, the cathetus dimension can be changed somewhat with respect to $x_o$ depending upon the position of the partial frequency band within the full frequency band of the waveguide.

Utilizing a side ratio of the rectangular waveguide a:b=2:1, FIG. 1*b* illustrates in detail how the respective SWRs of E-elbows change in a waveguide over a frequency range for an E-elbow with a bend angle of 90° and a few selected ratios x/a of the corner flattening or smoothing plane. Without corner flattening wherein the ratio x/a=0, an E-elbow represents an inducive disturbance with respect to a cross-section plane lying in the median line of the bend which inductive disruption increases greatly from the lower toward the top of the frequency range of a rectangular waveguide as shown. With increasing corner flattening or smoothing, in other words, increasing the quotient x/a, the inductive disruption becomes less and less. When the corner flattening or smoothing reaches a point where the ratio x/a=0.395, equal disruptions of r=5% will remain at the lower and upper frequency limits of the waveguide frequency range. These disruptions will have opposite phase angles and therefore such reflections will not fall below this value using a corner flattening method of compensation. Such reflections still represent a significant disruption in many utilizations which are standard today can be attributed to the fact that the compensation measure of corner flattening or smoothing alone is not precisely complementary to the disruption which is to be compensated over the entire frequency range of a rectangular waveguide.

For further reduction of the reflection factor over a relatively broad frequency band, it has already been proposed to provide a conductive cylindrical cross-bar in the area of the geometrical median of the bend, with the cross-bar being aligned parallel to the broad sides of the waveguide and extending between the narrow sides of the waveguide which lie opposite each other and to provide the flattening or smoothing plane with a conductive means as for example, a metal cylinder which projects into the interior space of the waveguide in the area of its diagonal point of intersection. An E-elbow compensated in these manners have very low reflection over an entire frequency band of the waveguide, but, however, the cost of manufacturing such devices is expensive because of the three different compensation features.

SUMMARY OF THE INVENTION

The object of the present invention is to provide an improved E-elbow which has a very low reflection factor over a relatively broad frequency band and which is relatively inexpensive to construct.

This object is achieved by modifying the prior art E-elbows by providing a cylindrical conductive cross-bar which extends parallel to the broad sides of the waveguide between the narrow sides of the waveguide which are opposite one another and which is located with the ends at the geometrical median of the bend of the elbow. The conductive cross-bar has an enlarged portion at the center of the bar which has a diameter $d_Q$ larger than the remaining portion of the bar outside the center area.

An additional structural embodiment of the invention provides that the enlargement of the diameter of the cross-bar can be eliminated in a rectangular waveguide elbow having a bend angle of 90° and a waveguide side ratio of a:b=2:1 when the ratio of x/a where x is the distance from the non-angled elbow to the point on the angled elbow where the flattening plane meets the broad side of the waveguide and where a is equal to the length of the broad side of the waveguide. In this invention, this ratio of x/a is selected to be approximately 0.352 and the conductive cross-bar is attached at a point comprising the mean height between the inner bend of the waveguide and the flattening plane. The diameter $d_Q$ of the cross-bar is selected to be at least approximately $d_Q/b=0.258$ where b is equal to the length of the narrow sides of the waveguide.

Other objects, features and advantages of the invention will be readily apparent from the following description of certain preferred embodiments thereof taken in conjunction with the accompanying drawings, although variations and modifications may be effected without departing from the spirit and scope of the novel concepts of the disclosure and in which:

DESCRIPTION OF THE PREFERRED EMBODIMENTS

This invention relates to my co-pending application entitled "Rectangular Waveguide Elbow Bent Across the Narrow Side with Capacitive Loading", U.S. patent application Ser. No. 101,577, filed Dec. 10, 1979.

Figures 1A, 1B:
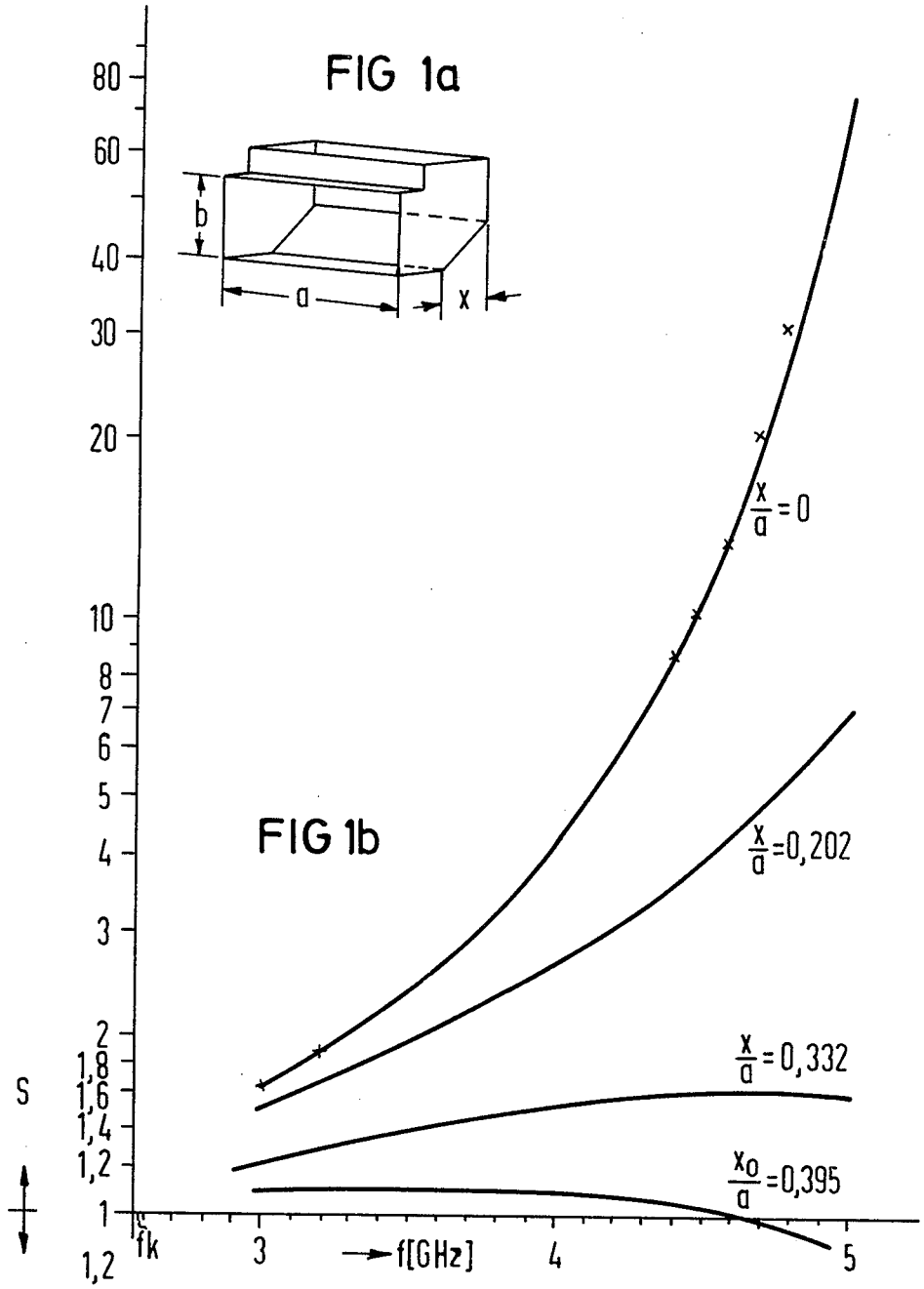
FIG. 1*a* is a perspective view of a prior E-elbow with symmetrical corner flattening or smoothing.
FIG. 1*b* is a plot of four curves illustrating various ratios of x/a and is a plot of frequency against standing wave ratio.
Figure 2:
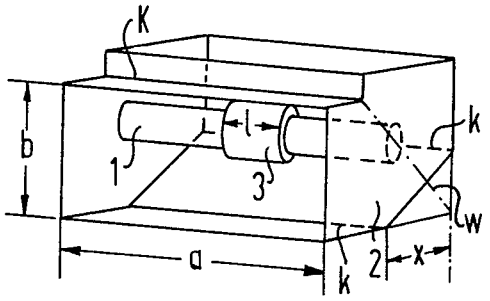
FIG. 2 is a perspective view of the invention.

FIG. 2 illustrates a waveguide elbow bent across the broad side a of the waveguide which is designated as an E-elbow and wherein the bend angle $\alpha=90°$ and in which the waveguide side ratio is selected to be a:b=2:1 and wherein the flattening plane or smoothing is given by the relationship x/a of the cathetus distance x to the broad side a of the waveguide. The distance x is equal to the distance from the untruncated elbow apex to the position where the symmetrical smoothing plane 2 joins with the broad side a of the waveguide as indicated in FIG. 2. In the present invention, the E-elbow is provided with a round conductive cross-bar 1 which extends parallel to the broad sides of the waveguide and extends between the narrow sides of the waveguide in the region of the bend and wherein the centerline of the cross-bar 1 is located at the median point between the inner bend K of the elbow and the plane 2 and is located on athe bisector w of the corner of the untruncated waveguide. Thus, the distances of the cross-bar 1 from the inner bend K and to the plane 2 are equal. The diameter $d_Q$ of the cross-bar 1 is selected to have a ratio to the narrow side b of the waveguide of 0.275. To provide additional compensation in the waveguide, a portion 3 having a length 1 with a diameter larger than the cross-bar 1 is mounted over the cross-bar 1 and electrically connected to the cross-bar 1 at its center portion. For example, the member 3 could be a collar which is slipped over the cross-bar 1. In a sample embodiment according to this invention, the ratio 1/a was chosen to be 0.17.

Figure 3:
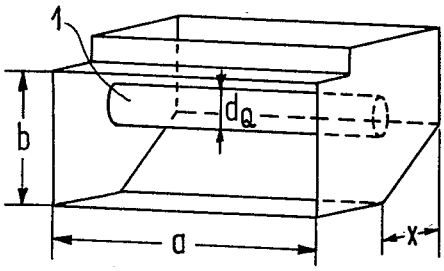
FIG. 3 is a perspective view of the modification of the invention.

FIG. 3 illustrates a further embodiment of the invention which is compensated by corner flattening or smoothing wherein the ratio x/a=0.352. A cross-bar 1 which is electrically conductive is mounted between the narrow walls of the waveguide parallel to the broad walls of the waveguide at the median angle of the bend as in FIG. 2, but the enlarged portion 3 is eliminated in the embodiment of FIG. 3 due to the fact that the diameter $d_Q$ of the cross-bar is selected so that the ratio $d_Q/b$ of the cross-bar will have a value of 0.258. In this embodiment, the cross-bar has a constant diameter which results in the cost of the device being cheaper than the one formed with an enlarged portion on the cross-bar. In the embodiment of FIG. 3, the waveguide side ratio a:b is equal to 2:1, however, when the dimensions of the waveguide side ratio and the bend angle $\alpha$ are known and vary from 2:1 and 90° corresponding values of x/a and $d_Q/b$ can be simply derived so as to provide compensation without the enlargement 3.

Figure 4:
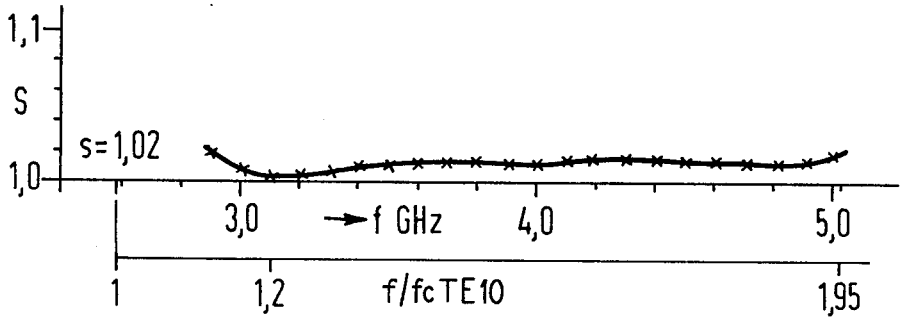
FIG. 4 is a plot illustrating the standing wave ratio for the embodiment illustrated in FIG. 3.

FIG. 4 comprises a plot of a measured curve for the standing wave ratio in the sample embodiment according to FIG. 3 plotted as a function of frequency.

As can be seen from FIG. 4, the E-elbow compensated according to the invention has reflection factors which are below 1% in the frequency range of 1.13 fcTE10 $<f<$1.95 fcTE10. Thus, according to the invention, an E-elbow compensated only with corner flattening or smoothing and having an $x_o/a$ ratio of 0.395 can be improved by at least a factor of 5 with respect to the reflection factor by utilizing the teachings of the present invention wherein the cross-bar 1 is utilized either with the enlarged portion 3 or wherein the cross-bar 1 has the diameter specified above relative to the FIG. 3 embodiment.

Although the invention has been described with respect to preferred embodiments, it is not to be so limited as changes and modifications may be made which are within the full intended scope of the invention as defined by the appended claims.

I claim as my invention:

1. A rectangular waveguide elbow bent across the broad side of the waveguide with an outer corner symmetrically angled by means of a conductive flattening plane, characterized in that a cylindrical, conductive cross-bar (1) is mounted parallel to the broad sides of the waveguide and extends between the narrow sides of the waveguide line opposite one another and is mounted with its center axis at the geometrical median (w) of the bend, and the condutive cross-bar (1) has an enlarged portion (3) symmetrically arranged at the center of the bar and which has a diameter $d_Q$ which is larger than the diameter of the end portions of the bar.

2. A rectangular waveguide elbow bent across the broad side of the waveguide according to claim 1, characterized in that for a bend angle of 90° and a waveguide side ratio of a:b=2:1, the enlarged portion (3) has a length to broad side of the waveguide ratio of at least approximately 0.17.

3. A rectangular waveguide elbow bent across the broad side of the waveguide characterized in that, given a bend angle of 90° and a waveguide side ratio of a:b=2:1, the relationship x/a of the interval x of the flattening edges (k) from the theoretical position of the outer bend edge of the non-angled elbow to the broad side a of the waveguide is selected to be at least approximately 0.352, a conductive cross-bar (1) attached at a mean height between the interior bend (K) and the flattening plane (2), and the diameter $d_Q$ of the cross-bar (1) is selected relative to the narrow side b of the waveguide to have a value of at least approximately $d_Q/b=0.258$.

* * * * *